US005815074A

United States Patent [19]

Sasagawa et al.

[11] Patent Number: 5,815,074

[45] Date of Patent: Sep. 29, 1998

[54] SIGNAL TRANSMISSION APPARATUS

[75] Inventors: Shinichi Sasagawa; Shin Kinouchi; Seishi Namioka; Nobuyuki Ichimiya, all of Miyagi-ken, Japan

[73] Assignee: Alps Electric Co., Ltd., Tokyo, Japan

[21] Appl. No.: 626,788

[22] Filed: Apr. 2, 1996

[30] Foreign Application Priority Data

Apr. 26, 1995 [JP] Japan ..... 7-102412

[51] Int. Cl.[6] ..... G08B 26/00

[52] U.S. Cl. ..... 340/505; 340/531; 340/533; 340/568

[58] Field of Search ..... 340/568, 531, 340/533, 538, 309.15, 693, 505, 514, 825.08, 825.54, 425.1

[56] References Cited

U.S. PATENT DOCUMENTS 4,041,470 8/1977 Slane et al. ..... 364/424.04
4,400,694 8/1983 Wong et al. ..... 340/505
4,573,041 2/1986 Kitagawa et al. ..... 340/531 X
4,994,788 2/1991 Phillippe et al. ..... 340/505
5,168,273 12/1992 Solomon ..... 340/505 X

FOREIGN PATENT DOCUMENTS 346199 12/1992 Japan ..... 340/505

*Primary Examiner*—Thomas J. Mullen, Jr.
*Attorney, Agent, or Firm*—Brinks Hofer Gilson & Lione

[57] ABSTRACT

A signal transmission apparatus including a main unit having a signal transmission terminal, and one or more sub units (or repeaters) each having first and second signal transmission terminals. A loop connection line is provided between the main unit and a first sub unit, and additional loop connection lines are provided between subsequent pairs of sub units to convey signals from the main unit to each of the sub units, and from each of the sub units to the main unit. The main unit includes a controller, a signal generator for generating and sending a first signal to one of the sub units, and a signal processor for processing a second signal returned from one of the sub units in response to the first signal. Each of the sub units includes a controller, a destination signal determination section, and a signal transfer section for selectively capturing and transferring a signal according to its destination address.

8 Claims, 10 Drawing Sheets

SIGNAL TRANSMISSION APPARATUS

BACKGROUND OF THE INVENTION

1. Field of the Invention

The present invention relates to a signal transmission apparatus associated with a theft monitoring apparatus and the like and, more particularly, to a signal transmission apparatus for sequentially transmitting a current signal or a voltage signal between a main unit and one or more sub units by sequentially connecting signal transmission terminals composed of photo couplers of the main unit and one or more sub units via loop connection lines in a chained manner or sequentially connecting the signal transmission terminals composed of signal send-receive devices via connection lines.

2. Description of the Related Art

For a signal transmission apparatus in which a main unit and one or more sub units are interconnected for signal transmission between the main unit and any of the sub units, those of series type and parallel type are known.

FIG. 9 shows a block diagram illustrating an example of the above-mentioned series-type signal transmission apparatus. FIG. 10 shows a block diagram illustrating the above-mentioned parallel-type signal transmission apparatus.

Now, referring to FIG. 9, the known series-type signal transmission apparatus comprises a main unit 51 and a plurality of sub units 52, 53 and 54. The main and sub units have the same constitution; that is, each unit has a signal transmission terminal composed of a send photocoupler 55 and a receive photocoupler 56, a send-receive circuit 57, and a signal processor 58. The send photocoupler 55 is composed of a phototransistor 63 and a light emitting diode (LED) 59. The receive photocoupler 56 is composed of a phototransistor 60 and a LED 61. In the main unit 51, the phototransistor 63 and the LED 61 is connected in series, the LED 59 is connected to the send portion of the send-receive circuit 57, the phototransistor 60 is connected to the receive portion of the send-receive circuit 57, and the send-receive circuit 57 is connected to the signal processor 58. In each of the sub units 52 through 54, the phototransistor 63 and the LED 61 are connected in series, the LED 59 is connected to the send portion of the send-receive circuit 57, the phototransistor 60 is connected to the receive portion of the send-receive circuit 57, and the send-receive circuit 57 is connected to the signal processor 58. The phototransistor 63 and the LED 61 of each of the main unit 51 and the sub units 52 through 54 are connected in series with a current source 62 to form a current loop.

The above-mentioned series-type signal transmission apparatus generally operates as follows.

When the signal processor, 58 of the main unit 51 generates a send signal, it is supplied to the LED 59 of the send photocoupler 55 via the second portion of the send-receive circuit 57 to generate an optical signal corresponding to the send signal. The optical signal is supplied to the phototransistor 63 arranged opposite to the LED 59. Based on this optical signal, the phototransistor 63 generates a current signal which is transmitted to the current loop to be supplied to the sub units 52 through 54 sequentially. Receiving the current signal, the sub units 52 through 54 converts the current signal to an optical signal through the LED 61 of the receive photocoupler 56, the resultant optical signal being supplied to the phototransistor 60. Receiving the optical signal, the phototransistor 60 generates a corresponding receive signal, which is supplied to the signal processor 58 via the receive portion of the send-receive circuit 57.

If the destination of the send signal generated by the main unit 51 is the sub unit 53, the sub unit 53 checks the receive signal supplied to the signal processor 58 for the destination of the signal. If the destination of the signal is found to be sub unit 53 itself, then the sub unit 53 captures the signal. If the other sub units 52 and 54 found that the signal is not for themselves, they discard the signal immediately. The same holds true when the destination of the signal transmitted from the main unit 51 is the sub unit 52 or 54.

If the signal processor 58 of the sub unit 52 generates a send signal of which destination is the sub unit 54, the signal is supplied to the LED 59 of the photocoupler 55 via the send-receive circuit 57 to be converted to an optical signal corresponding to the send signal. The resultant optical signal is then supplied to the phototransistor 63. Receiving the optical signal, the phototransistor 63 generates a current signal corresponding to the optical signal. The resultant current signal is transmitted to the current loop to be supplied to the sub units 53 and 54 and the main unit 51 sequentially. Receiving the current signal, the sub units 53 and 54 and the main unit 51 converts the current signal to an optical signal through the LED 61 of the receive photocoupler 56. The resultant optical signal is supplied to the phototransistor 60. The phototransistor 60 sends a receive signal corresponding to the received optical signal to the signal processor 58 via the send-receive circuit 57.

The sub unit 54 checks the receive signal supplied to the signal processor 58 for the destination. If the destination is found to be itself, the sub unit 54 captures the signal. The sub unit 53 and the main unit 51 discard the signal immediately if the same is not for themselves. The same holds true when the sub unit 53 or 54 generates a send signal and the destination of the send signal is the main unit 51 or the sub unit 52.

Referring to FIG. 10, the known parallel-type signal transmission apparatus comprises a main unit 71 and sub units 72, 73 and 74. The main unit 71 and the sub units 72 through 74 each have a signal transmission terminal composed of a send photocoupler 75 and a receive photocoupler 76, a send-receive circuit 77, and a signal processor 78. The send photocoupler 75 is composed of a phototransistor 84 and a LED 79. The receive photocoupler is composed of a phototransistor 80 and a LED 81. The phototransistor 84 and the LED 81 is interconnected in series. The LED 79 is connected to the send portion of the send-receive circuit 77 and the phototransistor 80 is connected to the receive portion of the send-receive circuit 77. The send-receive circuit 77 is connected to the signal processor 78. In this case, in the main unit 71, a series circuit of the phototransistor 84 and the LED 81 is further connected with a current source 82 and an internal resistor 83 in series. The series circuit of the phototransistor 84 and the LED 81 in the main unit 71 and each sub unit are connected in parallel. The resultant parallel circuit is connected with the series circuit of the main unit 71 composed of the phototransistor 84, the LED 81, the current source 82, and the internal resistor 83 for forming a current path for each of the sub units separately.

The above-mentioned parallel-type signal transmission apparatus generally operates as follows.

When the signal processor 78 of the main unit 71 generates a send signal, the same is supplied to the LED 79 of the send photocoupler 75 via the send portion of the send-receive circuit 77 to generate a corresponding optical signal. The optical signal is supplied to the phototransistor 84 opposite to the LED 79 to generate a corresponding current signal. The current signal is outputted from the main unit 71. This current signal is distributed to each of the current paths to be sent to the sub units 72 through 74 as a distributed current signal. Receiving the distributed current signal, the sub units 72 through 74 convert the same to an optical signal through the LED 81 of the receive photocoupler 76. The resultant optical signal is supplied to the phototransistor 80 opposite to the LED. The phototransistor 80 generates a corresponding receive signal, which is supplied to the signal processor 78 via the receive portion of the send-receive circuit 77.

If the destination of the send signal coming from the main unit 71 is the sub unit 73, the sub unit 73 checks the signal supplied to the signal processor 78 for the destination and, if it is for the sub unit 73, the sub unit 73 captures the signal. The other sub units 72 and 74 check the signal supplied to the signal processor 78 for the destination and, if it is not for them, discard the signal immediately. The same holds true when the destination is the sub unit 72 or 74.

Meanwhile, one of the main applications of the above-mentioned series-type signal transmission apparatus is a theft monitoring apparatus with a plurality of theft monitoring tags connected. This theft monitoring apparatus comprises a main unit corresponding to the main unit 51 and a plurality of repeaters corresponding to the sub units 52 through 54. Each of the repeaters is connected with a plurality of tags. In this constitution, each sub unit is assigned a unique identification number (ID) or a unique sub unit number at the time of fabrication to allow the main unit to know, when a theft is sensed at one of the tags, which sub unit the sensing tag belongs to.

In the above-mentioned known series-type signal transmission apparatus, when a current signal is sent from the main unit 51 or one of the sub units 52 through 54 to one current loop, the current signal flows through the phototransistors 63 and the LEDs 61 of the main unit and the plurality of sub units 52 through 54, so that the current source 62 needs to be one that generates a voltage set considering voltage drops in each phototransistor 63 and LED 61, for example, one that generates a relatively high voltage of 40V to 50V. Especially, when this series-type signal transmission apparatus is used for a theft monitoring apparatus, many sub units (or repeaters) need to be interconnected, thereby requiring to use a current source that generates an even higher voltage.

On the other hand, in the above-mentioned known parallel-type signal transmission apparatus, a current signal transmitted from the main unit 71 is distributed to each of the current paths and, when the distributed current is supplied to the plurality of sub units 72 through 74, the distributed current flows through the phototransistor 84 and the LED 81 of each of the plurality of sub units 72 through 74. Consequently, the current source 82 for use by the main unit 71 needs to be one that generates an output current that can flow through each of the phototransistors 84 and the LEDs 81, namely one that has a fairly large current capacity. Besides, when performing constant-current drive on each of the plurality of phototransistors 84 and the LEDs 81, a current source that generates a relatively high voltage as well as a relatively large current value needs to be used.

Further, when the above-mentioned known series-type signal transmission apparatus is used for a theft monitoring apparatus with a plurality of tags connected, it is necessary to assign the identification number (ID) or the sub unit number to each of the sub units as mentioned above. However, the conventional setting of the ID and the sub unit number is performed in an electrical manner by jumpering the internal circuit of each sub unit (or repeater) at the time of fabrication. And, after assigning the ID, the assigned number is labeled on the housing of sub unit to inform the user of the ID or sub unit number assigned to that sub unit, requiring additional time and cost in fabrication.

Still further, the above-mentioned known series-type and parallel-type signal transmission apparatuses use a lot of relatively costly photocouplers 55, 56, 75 and 76, pushing up the fabrication cost of the apparatuses in their entirety.

SUMMARY OF THE INVENTION

It is therefore a first object of the present invention to provide a signal transmission apparatus capable of using a current source that generates a relatively small amount of current at a relatively low voltage for supplying a current to drive a current loop.

It is a second object of the present invention to provide a signal transmission apparatus that automatically assign an identification number (or a sub unit number) to each of the sub units at starting the apparatus, thereby eliminating the necessity for manually assigning the identification number (or a sub unit number).

It is a third object of the present invention to provide a signal transmission apparatus for sequentially transmitting signals without increasing the apparatus fabrication cost.

In carrying out the invention and according to a first aspect thereof, there is provided a signal transmission apparatus comprising a main unit having a signal transmission terminal composed of a pair of photocouplers, at least one sub unit having a first signal transmission terminal and a second signal transmission terminal each composed of a pair of photocouplers, and a loop connection line for sequentially linking the signal transmission terminals opposite to each other between the main unit and the at least one sub unit and between the sub units, wherein the main unit has a controller for controlling the main unit in its entirety and a signal generator for generating and sending a current signal to the at least one sub unit, and a signal processor for processing a current signal coming from the at least one sub unit and the at least one sub unit has a controller for controlling the sub unit in its entirety, a destination signal determination section for determining the destination of a current signal to be supplied to the first signal transmission terminal, and a signal transfer section for capturing this current signal if, based on the result of determination made by the destination signal determination section, the current signal to be supplied to the first signal terminal is for own unit and transferring this current signal to the above-mentioned second signal transmission terminal if this current signal is for another unit and transferring the current signal to be supplied to the above-mentioned second signal transmission terminal to the above-mentioned first signal transmission terminal.

In carrying out the invention and according to a second aspect thereof, there is provided a signal transmission apparatus comprising: a main unit having a signal transmission terminal composed of a pair of photocouplers; at least one sub unit having a first signal transmission terminal and a second signal transmission terminal each composed of a pair of photocouplers; and a loop connection line for sequentially linking the signal transmission terminals opposite to each other between the main unit and the at least one sub unit and between the sub units; wherein the main unit has a control means for controlling the same in its entirety, number command means for sending a number setting command signal to the at least one sub unit at starting the signal transmission apparatus, and response signal receiving means for receiving a response signal coming from the at least one sub unit, and the at least one sub unit has a control means for controlling the same in its entirety, number setting means for setting, based on the number setting command signal to be supplied to the first signal transmission terminal, a sub unit number to the at least one sub unit, the sub unit number indicating the sequence of connection from the main unit, and display means for displaying the sub unit number set by the sub unit number setting means.

In carrying out the invention and according to a third aspect thereof, there is provided a signal transmission apparatus comprising: a main unit having a signal transmission terminal composed of signal sending means and signal receiving means; at least one sub unit having a first signal transmission terminal and a second signal transmission terminal each being composed of signal sending means and signal receiving means; and a loop connection line for sequentially linking the signal transmission terminals opposite to each other between the main unit and the at least one sub unit and between the sub units; wherein the main unit has control means for controlling the same in its entirety, signal generating means for generating and sending a voltage signal to the at least one sub unit, and signal processing means for processing a voltage signal coming from the at least one sub unit, and the at least one sub unit has control means for controlling the same in its entirety, destination signal determination means for determining a destination of a voltage signal to be supplied to the first signal transmission terminal, and signal transfer means for, based on a result of determination made by the destination signal determination means, capturing the voltage signal to be supplied to the first signal transmission terminal if the voltage signal is for the at least one sub unit and, if the voltage signal is for another unit, transferring the voltage signal to the second signal transmission terminal and transferring the voltage signal to be supplied to the second signal transmission terminal to the first signal transmission terminal.

According to the above-mentioned first aspect of the invention, separate loop connection lines are connected between the main unit and the sub unit and between the sub units and current signal transmission is sequentially performed along these separate loop connection lines. Because each loop connection line is only connected with a current source and two pairs of phototransistors and LEDs, the current source is required only to supply a voltage as low as about 10 V even if a voltage drop between the two pairs of phototransistors and LEDs is considered. In addition, because the current source is required only to drive the two LEDs, a current generated by the current source may be as small as about 20 mA.

Thus, according to the first aspect of the invention, a current source generating a relatively low voltage (about 10 V) and a relatively small current (about 20 mA) may be used unlike those high-capacity current sources used on conventional signal transmission apparatuses, resulting in reduced power consumption and reduced fabrication cost.

According to the second aspect of the invention, the main unit sends a number setting command signal to a first sub unit adjacently connected to the main unit when the signal transmission apparatus is activated. Receiving the number setting command signal, the first sub unit sets a sub unit number to itself. The sub unit number indicates the sequence of the connection from the main unit. The first sub unit displays the sub unit number on a display device disposed on its frame. Then, the first sub unit sends a new number setting command signal to a second sub unit adjacently connected to the first sub unit and returns a setting completion signal to the main unit. Receiving the new number setting command signal, the second sub unit sets its sub unit number to itself and displays the number on a display device disposed on its frame. The second sub unit sends a new number setting command signal to a third sub unit adjacently connected to the second sub unit. Receiving the new number setting command, the third sub unit sets its sub unit number to itself and displays the number on a display device disposed on its frame. This operation is repeated until a last sub unit connected to the signal transmission apparatus is reached.

Thus, according to the second aspect of the invention, the number setting command signals are transmitted from the main unit downward to the sub units sequentially, the sub units are automatically assigned with their unit numbers, which are displayed on their display devices. This novel setup eliminates the necessity for assigning sub unit numbers to the sub units separately at factory and manually labeling the sub unit numbers on the frames of the sub units.

According to the third aspect of the invention, the main unit and the sub units are connected with each other by separate connection lines and a voltage signal is transmitted from the main unit to the sub units over those separate connection lines sequentially. This novel setup ensures the voltage signal transmission without a high drive voltage.

Thus according to the third aspect of the invention, neither high drive voltage nor photocoupler need be used, significantly reducing the fabrication cost of the signal transmission apparatus.

The above and other objects, features and advantages of the present invention will become more apparent from the accompanying drawings, in which like reference numerals are used to identify the same or similar parts in several views.

DETAILED DESCRIPTION OF PREFERRED EMBODIMENTS

This invention will be described in further detail by way of example with reference to the accompanying drawings.

Figure 1A:
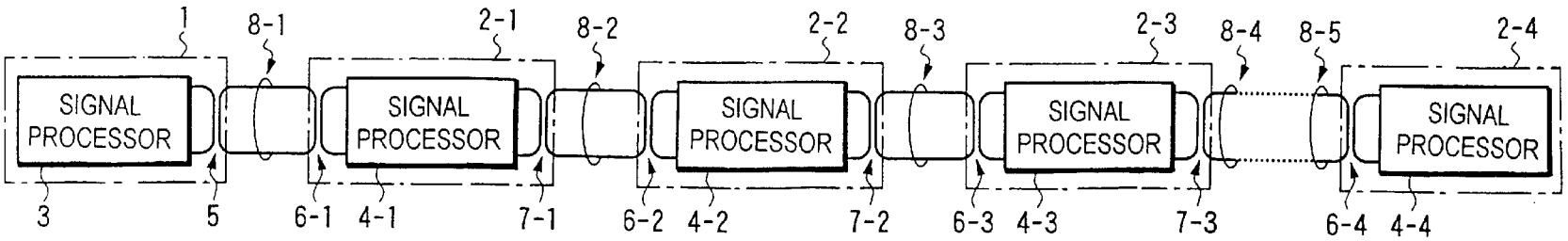
FIG. 1(A) is a schematic diagram illustrating a signal transmission apparatus practiced as a first preferred embodiment of the invention.
Figure 1B:
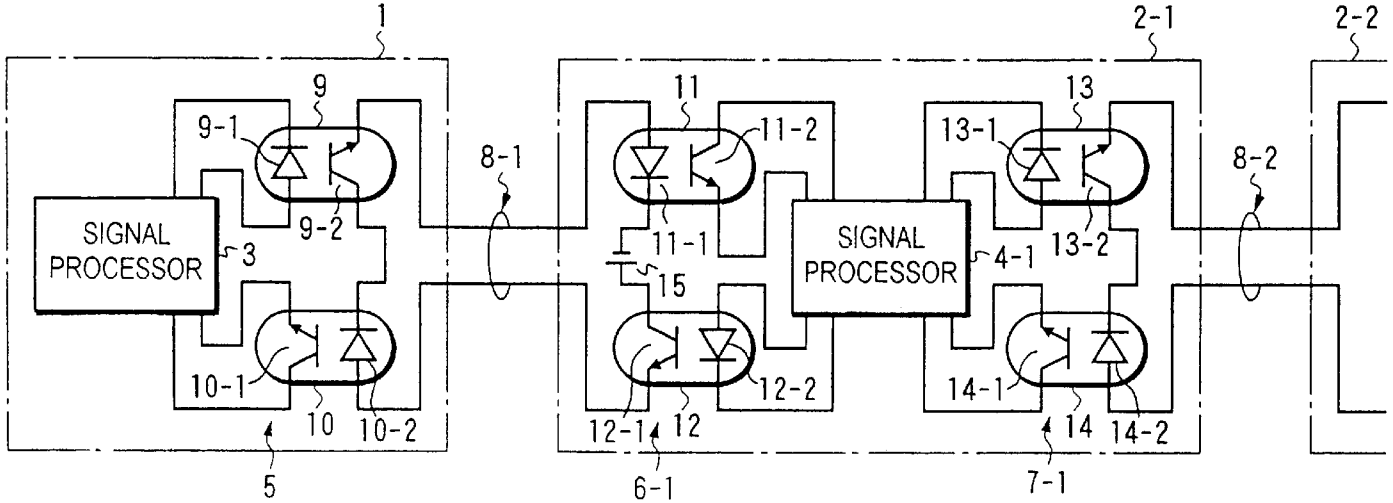
FIG. 1(B) is a partial block diagram of the embodiment of FIG. 1(A)

FIG. 1(A) shows a generation constitution of a signal transmission apparatus associated with the present invention practiced as the first preferred embodiment. FIG. 1(B) shows an example of a signal transmission terminal of the signal transmission apparatus of FIG. 1(A). This embodiment shows a theft monitoring apparatus.

Referring to FIG. 1(A), the theft monitoring apparatus comprises a main unit 1, a first repeater (or sub unit) 2-1 through a fourth repeater 2-4, and a first loop connection line 8-1 through a fifth loop connection line 8-5. The main unit 1 has a signal processor 3 and a signal transmission terminal 5. The repeaters 2-1 through 2-4 have signal processors 4-1 through 4-4, second signal transmission terminals 6-1 through 6-4, third signal transmission terminals 7-1 through 7-3, and current sources 15 respectively. In this case, at the fourth repeater 2-4, the third signal transmission terminal is not used. A first connection line 8-1 is connected between the signal transmission terminal 5 of the main unit 1 and the second signal transmission terminal 6-1 of the first repeater 2-1, a second connection line 8-2 between the third signal transmission terminal of the first repeater 2-1 and the second signal transmission terminal 6-2 of the second repeater 2-2, a third connection line 8-3 between the third signal transmission terminal 7-2 and the second signal transmission terminal 6-3 of the third repeater 2-3, a fourth connection line 8-4 between the third signal transmission terminal 73 of the third repeater 2-3 and the first signal transmission terminal, not shown, of a next repeater, not shown, and a fifth connection line between the second signal transmission terminal, not shown, of a repeater, not shown, connected prior to the fourth repeater 2-4 and the second signal transmission terminal 6-4 of the fourth repeater 2-4.

Referring to FIG. 1(B), the signal transmission terminal 5 of the main unit 1 is composed of a first photocoupler 9 consisting of a light emitting diode (LED) 9-1 and a phototransistor 9-2 and a second photocoupler 10 consisting of a phototransistor 10-1 and a LED 10-2. The second signal transmission terminal 6-1 of the first repeater 2-1 is composed of a first photocoupler 11 consisting of LED 11-1 and a phototransistor 11-2, a second photocoupler 12 consisting of a phototransistor 12-1 and a LED 12-2, and a current source 15. The third signal transmission terminal 7-1 of the first repeater 2-1 is composed of a first photocoupler 13 consisting of a LED 13-1 and a phototransistor 13-2, a second photocoupler 14 consisting of a phototransistor 14-1 and a LED 14-2, and a current source 15. It should be noted that, although not shown in FIG. 1 (B), the constitutions of the second signal transmission terminals 6-2 through 6-4 of the second through fourth repeaters 2-2 through 2-4 are generally the same as the constitution of the second signal transmission terminal 6-1 of the first repeater 2-1. Likewise, the constitutions of the third signal transmission terminals 7-2 through 7-3 of the second through the fourth repeaters 2-2 through 2-4 are generally the same as the constitution of the second signal transmission terminal 7-1 of the first repeater 2-1.

In the above-mentioned setup, in the signal transmission terminal 5 of the main unit 1, the LED 9-1 and the phototransistor 10-1 are connected at both ends thereof to the signal processor 3. The emitter of the phototransistor 9-2 is connected to the connection line 8-1, the collector thereof is connected to the cathode of the LED 10-2, and the anode of the LED 10-2 is connected to the connection line 8-1. In the first signal transmission terminal 6-1 of the first repeater 2-1, the anode of the LED 11-1 is connected to the connection line 8-1, the cathode thereof is connected to the collector of the phototransistor 12-1 via the current source 15, the emitter of the phototransistor 12-1 is connected to the connection line 8-1, and both ends of the phototransistor 12-2 and the LED 11-2 are connected to the signal processor 4-1. Likewise, in the second signal transmission terminal 7-1 of the first repeater 2-1, both ends of the LED 13-1 and the phototransistor 14-1 are connected to the signal processor 4-1, the emitter of the phototransistor 13-2 is connected to the connection line 8-2, the collector thereof is connected to the cathode of the LED 14-2, and the anode of the LED 14-2 is connected to the connection line 8-2.

It should be noted that, although not shown in FIG. 1(B), the connection constitution of the first signal transmission terminals 6-2 through 6-4 of the second through fourth repeaters 2-2 through 2-4 is generally the same as that of the first signal transmission terminal 6-1 of the first repeater 2-1. Likewise, the connection constitution of the second signal transmission terminals 7-2 through 7-3 of the second through fourth repeaters 2-2 through 2-4 is generally the same as that of the second signal transmission terminal 7-1 of the first repeater 2-1.

Figure 2:
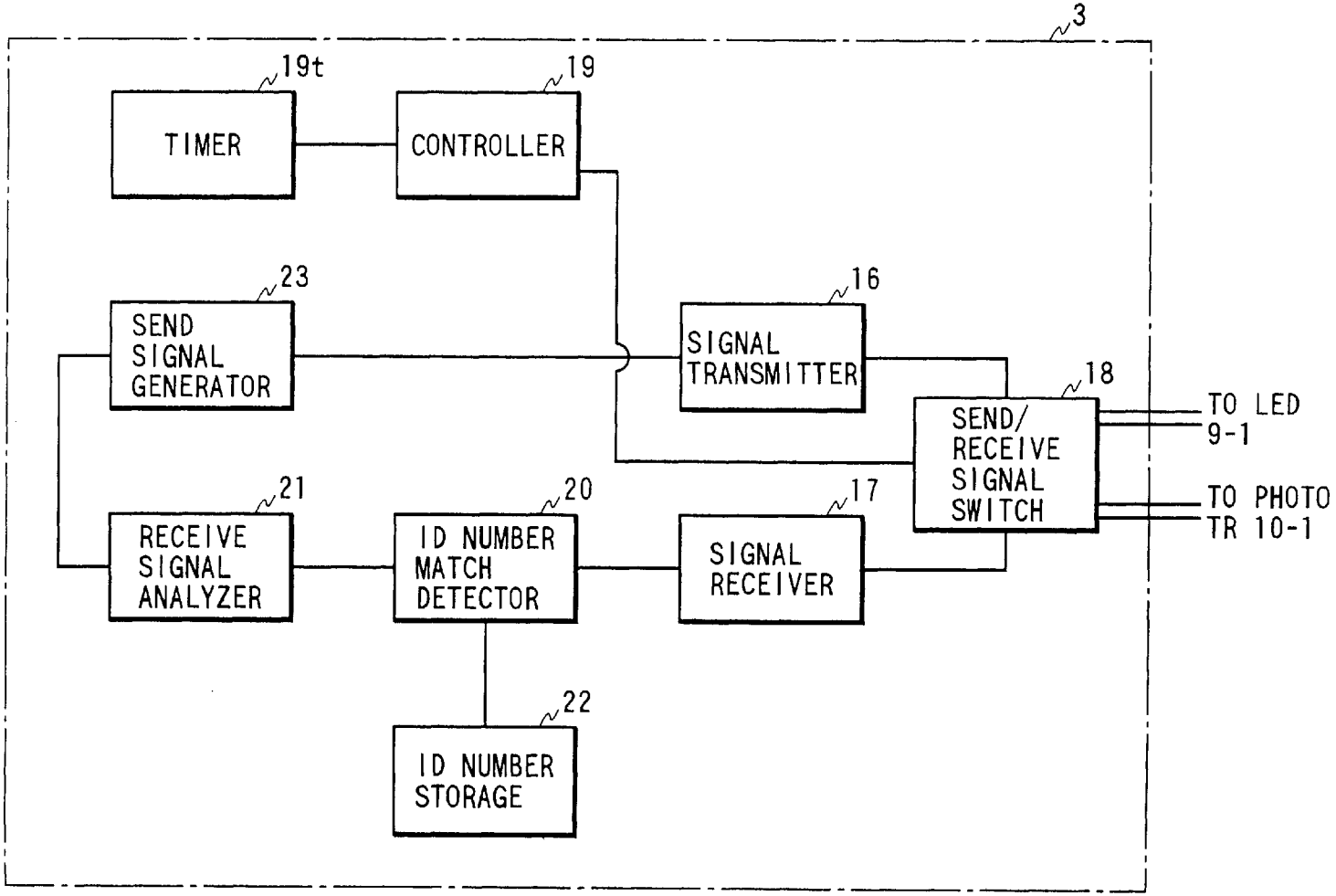
FIG. 2 is a block diagram illustrating a main unit of the signal transmission apparatus of FIG. 1 practiced as a second preferred embodiment of the invention.
Figure 3:
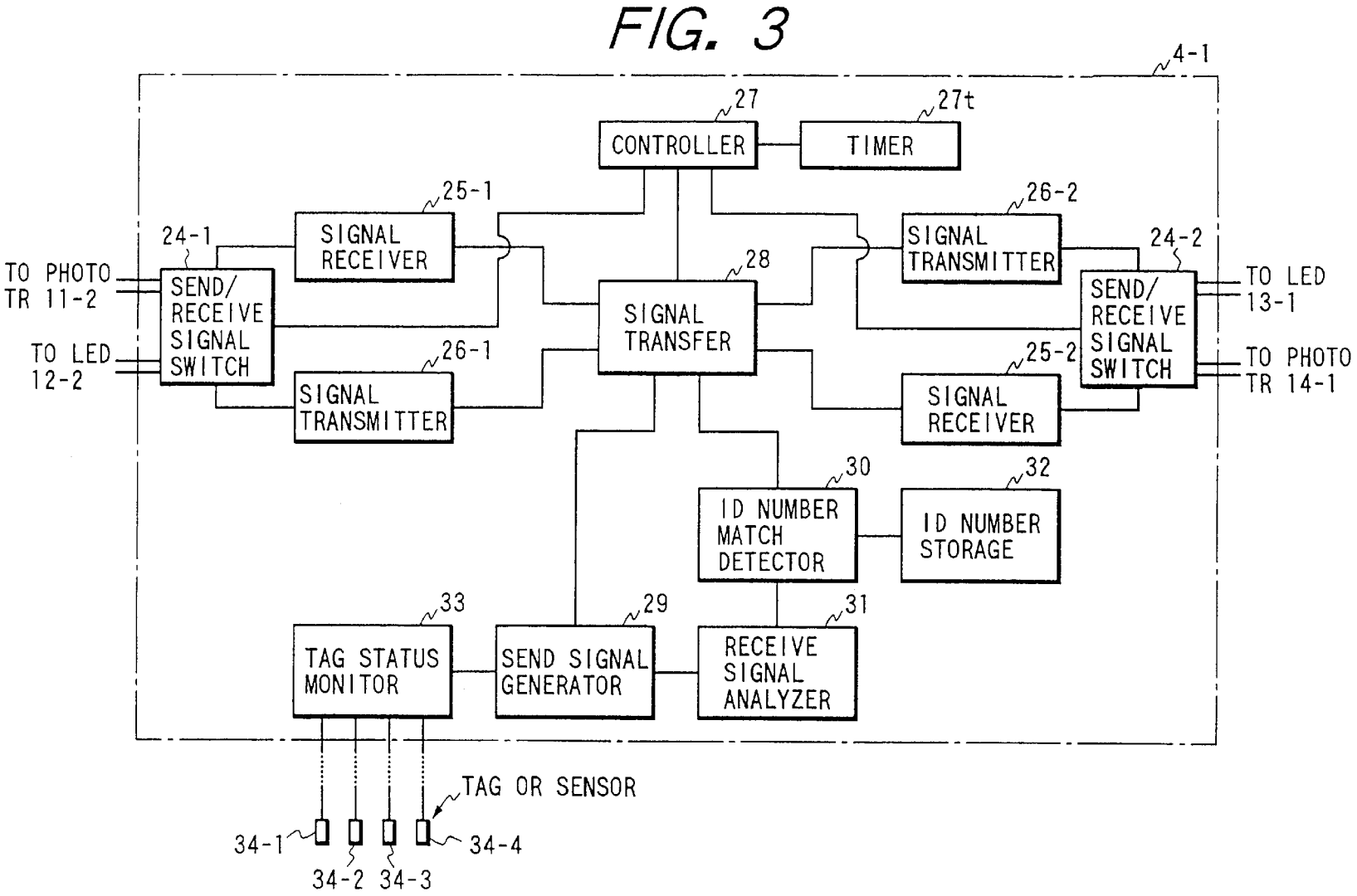
FIG. 3 is a block diagram illustrating a repeater of the signal transmission apparatus of FIG. 1 practiced as a third preferred embodiment of the invention.

FIG. 2 shows a block diagram of the signal processor used in the main unit 1 of the signal transmission apparatus of FIG. 1, practiced as first preferred embodiment of the invention. FIG. 3 shows the signal processor 4-1 used in the repeater 2-1 of the signal transmission apparatus of FIG. 1, practiced as the first preferred embodiment of the invention. The signal processors 4-1 through 4-4 are generally the same in construction and therefore only the construction of the signal processor 4-1 will be described for simplicity.

Referring to FIG. 2, the signal processor 3 of the main unit 1 comprises a signal transmitter 16 for transmitting a send signal, a signal receiver 17 for receiving a receive signal, a send/receive signal switch 18 for switching between transmission and reception, a controller 19 for controlling the entire signal processor, an ID number match detector 20 for detecting a match between an ID number (equivalent to a sub unit number) of a receive signal and a stored number, a receive signal analyzer 21 for analyzing the receive signal, an ID number storage 22 for storing the ID number of its own and ID numbers of the repeaters 2-1 through 2-4, a send signal generator 23 for generating a send signal, and a timer 19*t* for supplying timing information to the controller 19. In this constitution, the send signal generator 23, the signal transmitter 16, and the sending side of send/receive signal switch 18 constitute the signal generating section, while the receiving side of the send/receive signal switch 18, the signal receiver 17, the ID number match detector 20, the receive signal analyzer 21, and the ID number storage constitute the signal processing section.

The send/receive signal switch 18 has an input terminal connected to the output of the signal transmitter 16, an output terminal connected to the input of the signal receiver 17, a control terminal connected to the controller 19, a send terminal connected to both ends of the LED 9-1, and a receive terminal connected to both ends of the phototransistor 10-1. The output of the send signal generator 23 is connected to the input of the signal transmitter 16 and the output of the receive signal analyzer 21 is connected to the input of the send signal generator 23. The output of the signal receiver 17 is connected to the input of the ID number match detector 20 and the output of the same is connected to the input of the receive signal analyzer 21. The ID number storage 22 is connected to the ID number match detector 20 and the timer 19*t* is connected to the controller 19.

Referring to FIG. 3, the signal processor 4-1 of the first repeater 2-1 comprises a first send/receive signal switch 24-1 for switching between transmission and reception, a first signal receiver 25-1 for receiving a receive signal, a first signal transmitter 26-1 for transmitting a send signal, a second signal receiver 25-2 for receiving a receive signal, a second signal transmitter 26-2 for transmitting a send signal, a controller 27 for controlling the entire signal processor 4-1, a timer 27*t* for supplying timing information to the controller 27, a signal transferer 28 for transferring branching and injecting a signal, a send signal generator 29 for generating a send signal, an ID number match detector 30 for detecting a match between the ID number of the receive signal and the stored ID number, a receive signal analyzer 31 for analyzing a receive signal, an ID number storage 32 for storing the ID number of its own, and a tag status monitor 33 for monitoring the status of a plurality of theft monitoring tags 34-1 through 34-4 connected externally. In this case, the ID number match detector 30, the receive signal analyzer 31, and the ID number storage 32 constitute a destination signal determination section. It should be noted that unique ID numbers are set to the first through fourth repeaters 2-1 through 2-4 in advance and these ID numbers are stored in the ID number storage 32 in these repeaters respectively.

The first send/receive signal switch 24-1 has the output terminal connected to the input of the first signal receiver 25-1, the input terminal connected to the output of the first signal transmitter 26-1, the control terminal connected to the controller 27, the send terminal connected to both ends of the LED 11-2, and the send terminal connected to both ends of the phototransistor 12-2. The second send/receive signal switch 24-2 has the output terminal connected to the input of the second signal receiver 25-2, the input terminal connected to the output of the second signal transmitter 26-2, the control terminal connected to the controller 27, the send terminal connected to both ends of the LED 13-1, and the receive terminal connected to both ends of the phototransistor 14-1. The signal transferer 28 has the first input terminal connected to the output of the first signal receiver 25-1, the second input terminal connected to the output of the second signal receiver 25-2, the second output terminal connected to the input of the second signal transmitter 26-2, the control terminal connected to the controller 27, the injection terminal to be connected to the output of the send signal generator 29, and the branch terminal connected to the input of the ID number match detector 30. The input of the send signal generator 29 is connected to the output of the receive signal analyzer 31 and the output of the tag status monitor 33 and the output of the ID number match detector 30 is connected to the input of the receive signal analyzer 31. The ID number storage 32 is connected to the ID number match detector 30 and the timer 27*t* is connected to the controller 27. It should be noted that the constitutions and connections of the signal processors 4-2 through 4-4 of the repeaters 2-2 through 2-4 are generally the same with those of the signal processor 4-1 of the first repeater 2-1.

The following describes the operations of the theft monitoring apparatus having the above-mentioned constitution with reference to FIGS. 1(A) and (B), FIG. 2, and FIG. 3.

The theft monitoring apparatus is activated with the main unit 1 connected with the first through fourth repeaters 2-1 through 2-4 sequentially as shown in FIG. 1(A) and with the tag status monitors 33 in the signal processors 4-1 through 4-4 of the first through fourth repeaters 2-1 through 2-4 connected with the tags 34-1 through 34-4 respectively. Then, when one signal transmitting operation is performed in the theft monitoring apparatus, the send/receive signal switch 18 of the signal processor 3 of the main unit 1 is set to the send side by the controller 19, and, in the signal processors 4-1 through 4-4 of the first through fourth repeaters 2-1 through 2-4, the first send/receive signal switch 24-1 is set to the receive side and the second send/receive signal switch 24-2 is set to the send side by the controller 27.

First, in the signal processor 3 of the main unit 1, the send signal generator 23 generates a signal addressed to one of the first through fourth repeaters 2-1 through 2-4. In this case, the signal that the send signal generator 23 generates is formed by a four-byte data packet with one frame consisting of eight bits for example. In this data packet, the first eight bits provide an ID indicating the destination of data, the second eight bits provide a command, the third eight bits provide an ID indicating the source of data, and the fourth eight bits provide a tag number for sending a command and the like. This signal is supplied to the first photocoupler 9 via the signal transmitter 16 and the send/receive signal switch 18 set to the send side. The signal is then transmitted from the first photocoupler 9 to the first photocoupler 11 of the first repeater 2-1 via the first connection line 8-1 as the current signal to be supplied to the signal processor 4-1.

Then, in the first repeater 2-1, the signal supplied from the first photocoupler 11 is supplied from the first send/receive signal switch 24-1 set to the receive side to the signal receiver 25-1 to the signal transferer 28. The signal transferer extracts the ID indicating the destination of the supplied signal under the control of the controller 27, sending the extracted ID to the ID number match detector 30. The ID number match detector 30 compares the ID supplied from the signal transferer 28 with the unique ID of the first repeater 2-1 stored in the ID number storage 32. If a match is found, the ID number match detector 30 determines that this signal is for the first repeater 2-1, upon which the signal is sent from the signal transferer 28 to the receive signal analyzer 31 via the ID number match detector 30. In this state, the first send/receive signal switch 24-1 is set to the send side by the controller 27. The receive signal analyzer 31 executes processing specified by the supplied signal and, at the same time, drives the send signal generator 29 to generate a response signal. In this case, the response signal contains an ID indicating data destination, a command, an ID indicating data source, and the like. The response signal is supplied from the signal transferer 28 to the second photocoupler 12 via the first signal transmitter 16-1 and the first send/receive signal switch 24-1 set to the send side. The response signal is then supplied from the second photocoupler 12 to the second photocoupler 10 in the main unit 1 via the first connection line 8-1 as the current signal to be supplied to the signal processor 3.

In the main unit 1, the response signal supplied from the second photocoupler 10 is supplied to the ID number match detector 20 via the send/receive signal switch 18 already set to the receive side by the controller 19 and via the signal receiver 17. The ID number match detector 20 compares the source ID contained in the response signal with the ID stored in the ID number storage 22. If a match is found, the response signal is supplied to the receive signal analyzer 21 for required processing.

Meanwhile, in the first repeater 2-1, the ID number match detector 30 compares the ID supplied from the signal transferer 28 with the unique ID of the first repeater stored in the ID number storage 32. If a mismatch is found, the ID number match detector 30 determines that the signal is addressed to a repeater other than the first repeater 2-1 and controls the signal transferer 28 to transfer the signal to the second signal transmitter 26-2. This signal is supplied to the first photocoupler 13 via the second signal transmitter 26-2 and the second signal switch 24-2 set to the send side to be transmitted to the second repeater 2-2 via the second connection line 8-2 as the current signal.

Then, in the second repeater 2-2, the same operations as those performed in the first repeater 2-1 are performed, so that if the destination of the signal is the second repeater 2-2, a response signal is transmitted from the second repeater 2-2. If the destination of the receive signal is not the second repeater 2-2, then the signal is sent to the third repeater 2-3. In the third repeater 2-3, the same operations as those performed in the first repeater 2-1 are performed. The same holds true with the fourth repeater 2-4.

In the first repeater 2-1, when the signal is transmitted to the second repeater 2-2, the second send/receive signal switch 24-2 is set by the controller 27 to the receive side. At this moment, when a response signal comes from the second repeater 2-2, the response signal is transmitted to the signal transferer 28 via the second send/receive signal switch 24-2 set to the receive side and the second signal receiver 25-2. Receiving the response signal, the signal transferer 28 transfers the same to the first signal transmitter 26-1. This response signal is then supplied to the second photocoupler 12 via the first send/receive signal switch 24-1 already set to the send side by the controller 27 then to the second photocoupler 10 in the main unit 1 via the first signal line 8-1 and to the signal processor 3, upon which the same operations as mentioned above are performed in the signal processor 3.

Thus, in the present theft monitoring apparatus, the main unit 1 sends a signal addressed to one of the first through fourth repeaters 2-1 through 2-4, the fourth repeater 2-4 for example. When the main unit confirms that a response signal has come from the fourth repeater 2-4 within a certain period set by the timer 19*t*, the main unit 1 assumes that the signal transmission between the main unit 1 and the fourth repeater 2-4 has been successful and transmits another signal addressed to one of the first through fourth repeaters 2-1 through 2-4. Thus, the signal transmission between the main unit 1 and any one of the first through fourth repeaters 2-1 through 2-4 is performed sequentially.

If the main unit 1 has transmitted a signal addressed to one of the first through fourth repeaters 2-1 through 2-4, the third repeater 2-3 for example, and detected that a response signal returned from the third repeater 2-3 contains information indicating an abnormal condition in any of the tags 34-1 through 34-4 connected to the tag status monitor 33 of the third repeater 2-3, commodities for example attached with the tags 34-1 through 34-4 can be prevented from theft for example.

Thus, according to the theft monitoring apparatus of the present embodiment, when a current signal is transmitted between the main unit 1 and the plurality of repeaters 2-1 through 2-4 over the loop connection lines 8-1 through 8-5 sequentially, to be considered at driving the current in each of the loop connection lines are only the voltage drop in the two pairs of phototransistors and LEDs and the magnitude of the drive current in the LEDs because the transmission involves only these two pairs in each of the loop connection lines. Consequently, the current source 15 of FIG. 1(B) for driving each loop connection line may only output a relatively low voltage of about 10 V. In addition, at the constant current driving of the current source 15, the current source may only output a relatively small current of about 20 mA.

Further, according to the theft monitoring apparatus of the present embodiment, if the power supply for the repeaters 2-1 through 2-4 can be allocated, more repeaters can be connected to the main unit. In this case, a loop connection line between repeaters can be made fairly long, thereby increasing the length of the theft monitoring apparatus substantially to any desired level.

It should be noted that, according to the theft monitoring apparatus of the present embodiment, a signal is sequentially transmitted from the main unit 1 to the first repeater 2-1 to the second repeater 2-2 and to the third repeater 2-3 for example, so that the signal transmission speed is slightly lower than that in conventional signal transmission apparatuses. However, this transmission speed is sufficient for the theft monitoring apparatus such as the present embodiment that need not operate at higher speeds.

Figure 4:
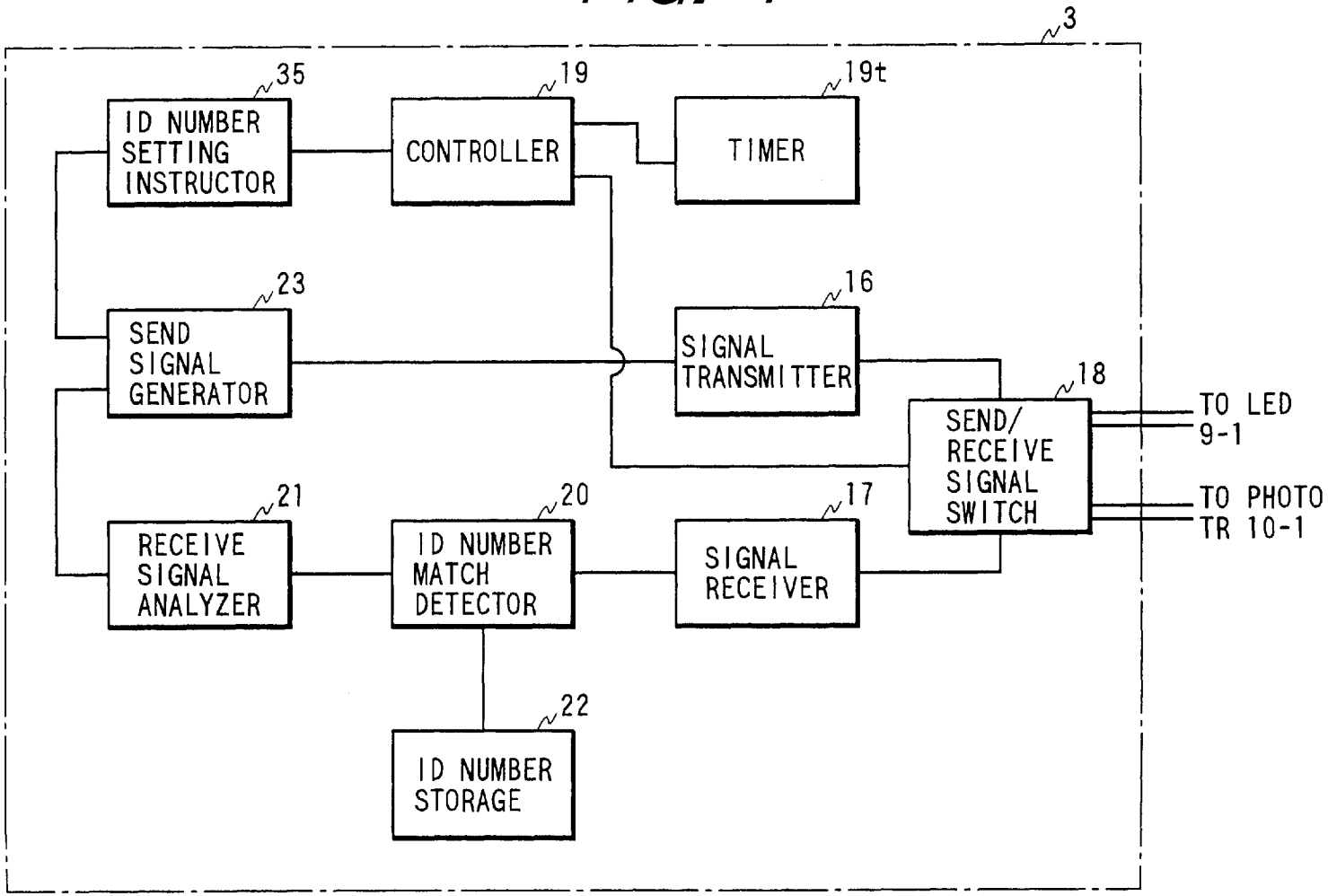
FIG. 4 is a block diagram illustrating the main unit of the signal transmission apparatus of FIG. 1 practiced as a fourth preferred embodiment of the invention.
Figure 5:
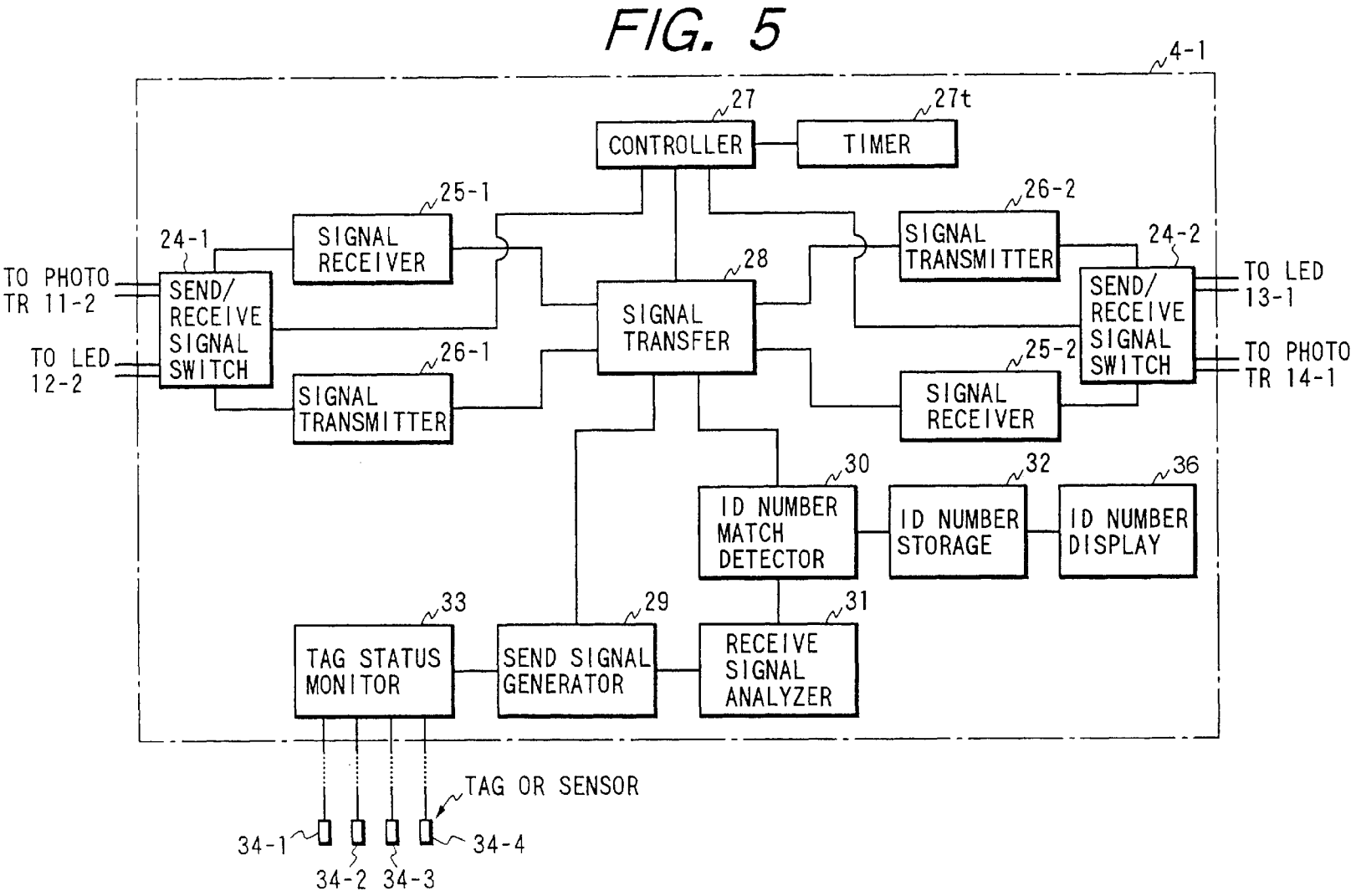
FIG. 5 is a block diagram illustrating the repeater of the signal transmission apparatus of FIG. 1 practiced as a fifth preferred embodiment of the invention.

FIG. 4 shows a block diagram of the signal processor 3 of the main unit 1 of FIGS. 1(A) and (B), practiced as a fourth preferred embodiment of the present invention. FIG. 5 shows the block diagram of one of the signal processors 4-1 through 4-4 in the repeaters 2-1 through 2-4 of FIGS. 1(A) and (B), practiced as a fifth preferred embodiment of the present invention. In the figure, the repeater 4-1 is shown representatively. This example shows that, when the embodied theft monitoring is activated, ID numbers are set to the first through fourth repeaters 2-1 through 2-4 sequentially connected to the main unit 1 and the ID number thus set are displayed on these repeaters respectively.

The differences in constitution between the main unit 1 of the fourth embodiment of FIG. 4 and the main unit 1 of the second embodiment of FIG. 2 are as follows. The fourth embodiment of has an ID number setting instructing circuit 35 for generating an ID number setting command signal, the circuit 35 being connected to the controller 19 and the send signal generator 23. The second embodiment has no ID number setting instructing circuit and there is no connection between the controller 19 and the send signal generator 23. The rest is the same between both embodiments in constitution. Consequently, the components of the fourth embodiment similar to those of the second embodiment are denoted by the same reference numerals and omitted from the following description for simplicity.

The differences between the constitution of the signal processor 4-1 in the first repeater 2-1 of the fifth embodiment of FIG. 5 and that of the signal processor 4-1 in the first repeater 2-1 of the third embodiment of FIG. 3 are as follows. The fifth embodiment has an ID number display 36 arranged on the frame, not shown, of the first repeater 2-1 to display the unique ID number set to the same. The ID number storage 32 is connected to the ID number display 36 which is connected to the receive signal analyzer 31. The third embodiment has no ID number display 36 and there is no connection between the ID number storage 32 and the ID number display 36 and between the ID number storage 32 and the receive signal analyzer 31. The rest is the same between these embodiments in constitution. Consequently, the components of the fifth embodiment similar to those of the third embodiment are denoted by the same reference numerals and omitted from the following description for simplicity. It should be noted that, in the fifth embodiment, the signal processors of the first through fourth repeaters 2-1 through 2-4 have the same constitution. It should be also noted that the ID number display 36 arranged on each of the repeaters uses a flexible display device composed of a 7-segment LED (Light Emitting Diode) for example. In this case, in the fifth embodiment, the signal transmitter 16, the send side of the send/receive signal switch 18, the ID number match detector 20, the receive signal analyzer 21, the ID number storage 22, the send signal generator 23, and ID number setting instructing circuit 35 on the main unit 1 side form a number instructing section as a whole. The receive signal analyzer 31 and the ID number storage 32 on the repeater side form a number setting section.

The following describes the operations of the theft monitoring apparatus of the fifth embodiment associated with the above-mentioned constitution with reference to FIGS. 1(A) and (B), FIG. 4 and FIG. 5.

The main unit 1 is connected sequentially with the first through fourth repeaters 2-1 through 2-4 as shown in FIG. 1(A). Further, the tag status monitor 33 in each of the signal processors 4-1 through 4-4 of the first through fourth repeaters 2-1 through 2-4 is connected with the plurality of tags 34-1 through 34-4. Then, the theft monitoring apparatus is powered on to start operation.

As soon as the theft monitoring apparatus starts operating, in the signal processor 3 of the main unit 1, the send/receive signal switch 18 is set to the send side by the controller 19. In the signal processors 4-1 through 4-4 of the first through fourth repeaters 2-1 through 2-4, the first send/receive signal switch 24-1 is set to the receive side by the controller 27 and the second send/receive signal switch 24-2 is set to the send side.

Then, in the signal processor 3 of the main unit 1, the ID number setting instructing circuit 35 generates a number setting command for setting the first repeater 2-1 to the destination and ID number (equivalent to sub unit number) one through use of the ID number match detector 20, the receive signal analyzer 21, and the ID number storage 22. Based on this number setting command, the send signal generator 23 generates a number setting command signal. The number setting command signal is supplied to the first photocoupler 9 via the signal transmitter 16 and the send/receive signal switch set to the send side. The signal is then transmitted to the first photocoupler 11 of the first repeater 2-1 to be supplied to the signal processor 4-1.

In the first repeater 2-1, the number setting instructing signal coming from the first photocoupler 11 is transmitted to the signal receiver 25-1 via the first send/receive signal switch 24-1 set to the receive side to be supplied to the signal transferer 28. At this moment, the signal transferer supplies the number setting instructing signal supplied by the controller 27 to the receive signal analyzer 31 via the ID number match detector 30. From the supplied number setting instructing signal, the receive signal analyzer 31 extracts the ID number (number 1) assigned to this repeater and stores the extracted ID number in the ID number storage 32 and, at the same time, sends the same to the ID number display 36 arranged on the frame of the first repeater 2-1. When these operations have been completed, the receive signal analyzer 31 operates to make the send signal generator 29 generate a setting completion signal indicating the completion of the setting of the ID number and a new number setting instructing signal for setting an ID number 2 (equivalent to sub unit number) to the second repeater 2-2. These signals are sent to the signal transferer 28. From the signal transferer 28, the setting completion signal is sent to the second photocoupler 12 via the first signal transmitter 26-1 and the first send/receive signal switch 24-2 already set by the controller 27 to the send side. This signal is then sent to the second photocoupler 10 of the main unit 1 via the first connection line 8-1 as the current signal to be supplied to the signal processor 3. On the other hand, the new number setting instructing signal is sent from the signal transferer 28 to the first photocoupler 13 via the second send/receive signal switch 24-2 set to the send side. This signal is then transmitted to the second repeater 2-2 via the second connection line 8-2 as the current signal.

In the second repeater 2-2, when the new number setting instructing signal comes, the same operations as those performed when the number setting instructing signal came to the first repeater 2-1 are performed. Namely, the ID number 2 is stored in the ID number storage 32 and, when the ID number 2 is displayed on the ID number display 36 arranged on the frame of the second repeater 2-2, a setting completion signal is sent to the first repeater 2-1 and, at the same time, a new number setting instructing signal for setting ID number 3 to the third repeater 2-3 is sent to the same. The same operations as mentioned above are performed in the third repeater 2-3 and the fourth repeater 2-4. The ID number 3 is stored in the ID number storage 32 of the third repeater 2-3 and is displayed on the ID number display 35. Likewise, the ID number setting and displaying are performed on the fourth repeater 2-4. Thus, the unique ID number (sub unit number) is set to each of the repeaters 2-1 through 2-4 to be displayed thereon.

In the above-mentioned case, in the first through fourth repeaters 2-1 through 2-4, when a new number setting instructing signal is transmitted to a next connected repeater in the direction opposite to the main unit 1, the controller 27 sets the second send/receive signal switch 24-2 to the receive side and the first send/receive signal switch 24-1 to the send side and operates a timer 27*t* set to a predetermined time. If a setting completion signal is generated in the repeater during a period from the operation of the timer 27*t* until the passing of the predetermined time, the setting completion signal is transmitted to the main unit 1 via the second signal receiver 25-2, the signal transferer 28, and the first signal transmitter 26-1. On the other hand, if no setting completion signal is generated after the passing of the predetermined time set on the timer 27*t*, the receive signal analyzer 31 makes the send signal generator 29 transmit the ID number of that repeater to the main unit 1 as a last repeater (sub unit) number signal indicating that the repeater is the last one in the series of repeaters connected to the main unit.

When the setting completion signals come from the first through fourth repeaters 2-1 through 2-4 and when the last repeater (sub unit) number signal comes from the last repeater, these signals are supplied to the receive signal analyzer 21 via the signal receiver 17 and the ID number match detector 20. Based on these signals, the receive signal analyzer 21 knows that the unique ID numbers have been set to the first through fourth repeaters 2-1 through 2-4 respectively and the number of repeaters connected to the main unit 1.

In the fifth embodiment, when the setting of the ID numbers to the first through fourth repeaters 2-1 through 2-4 has been completed, the same operations as those performed in the third embodiment are performed, the theft monitoring being performed by the plurality of tags 34-1 through 34-4 as in the third embodiment.

Thus according to the fifth embodiment, when the theft monitoring apparatus is activated, the number setting instructing signal is supplied to the repeaters 2-1 through 2-4 from the main unit 1 or the repeaters 2-1 through 2-3 connected to the main unit 1. Based on the number setting instructing signal, the unique IDs are set to the repeaters and displayed on the ID display 36 thereof respectively, thereby eliminating the necessity for manually labeling the ID numbers to the repeaters. Besides, all the repeaters can be fabricated in the same process to significantly reduce the fabrication cost and prevent a number assignment mistake from happening.

Figure 6:
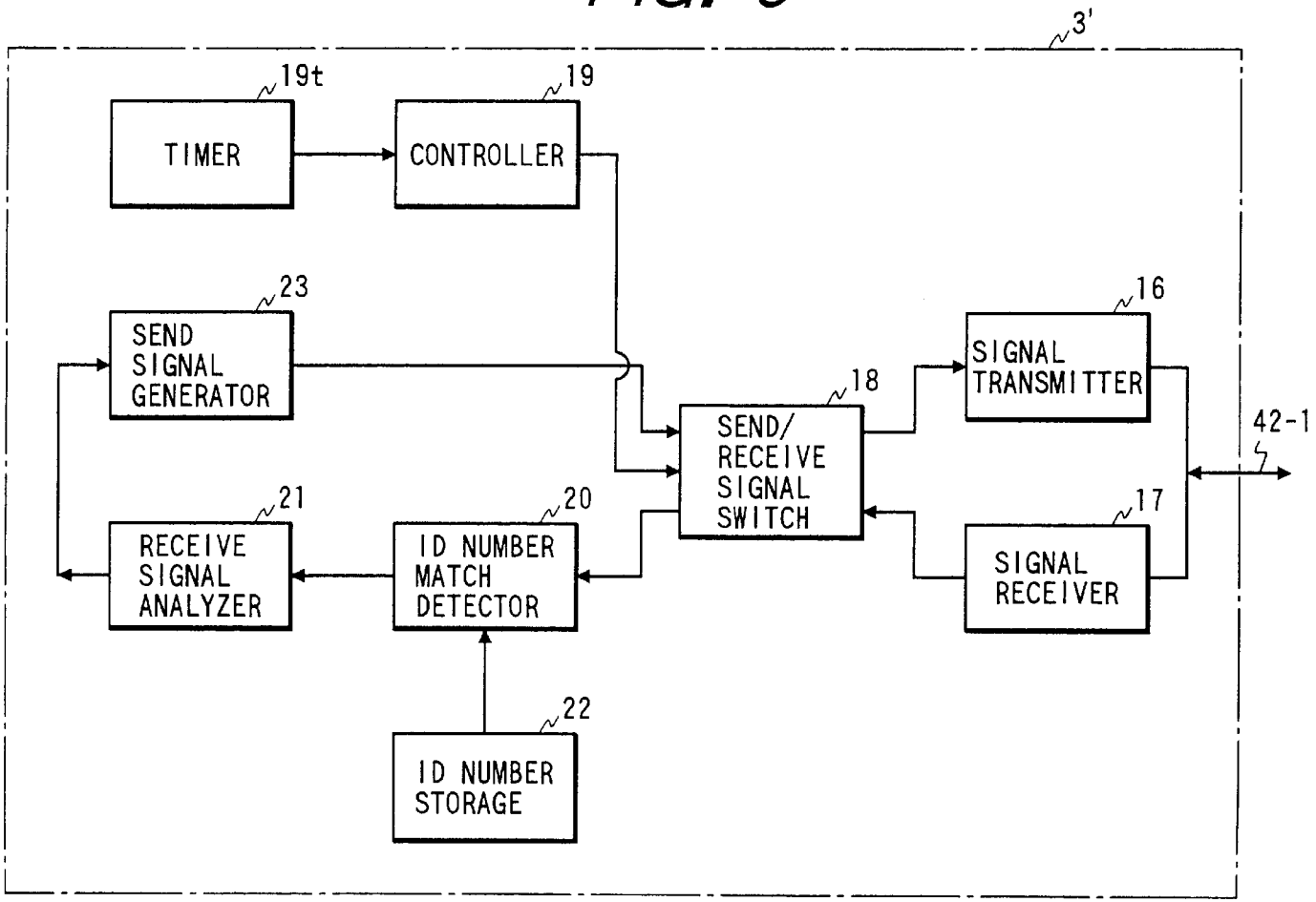
FIG. 6 is a block diagram illustrating the main unit of the signal transmission apparatus of FIG. 1 practiced as a sixth preferred embodiment of the invention.
Figure 7:
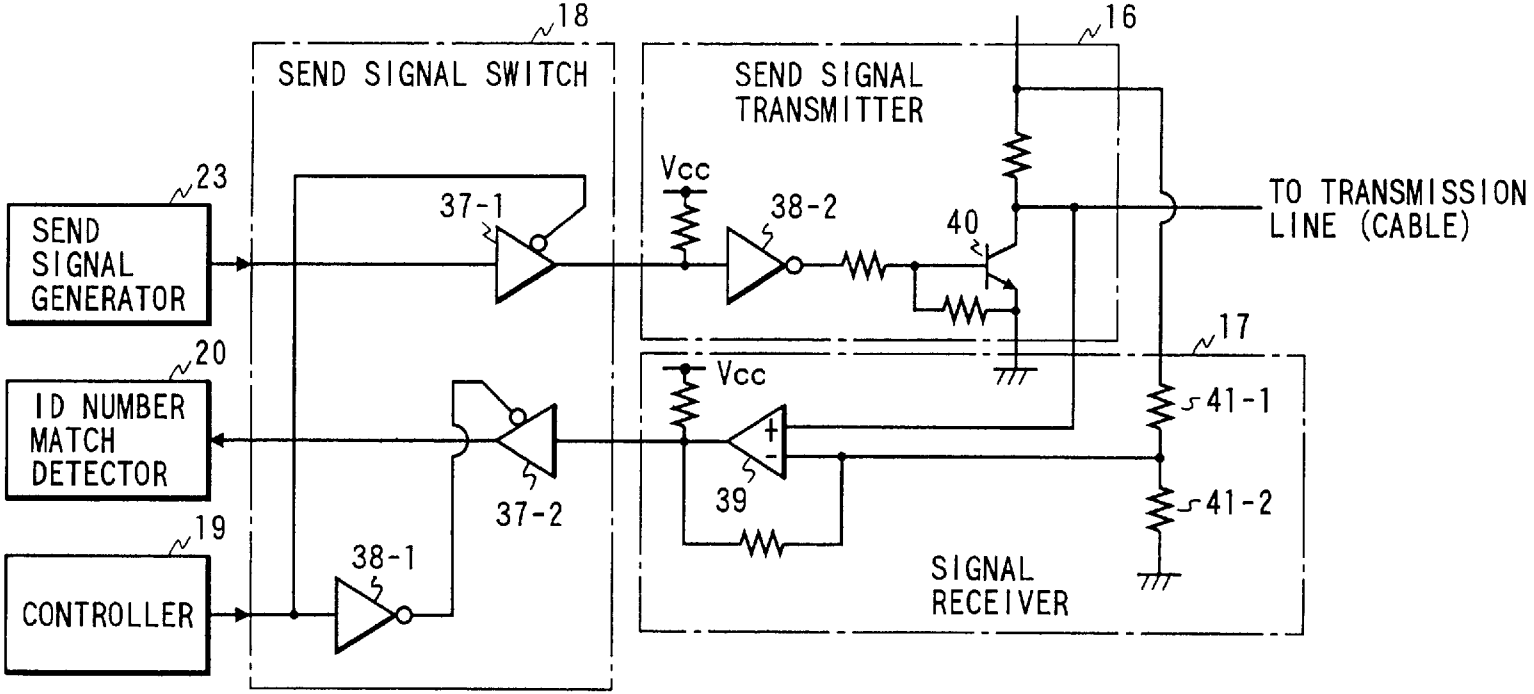
FIG. 7 is a block diagram illustrating a part of the main unit of FIG. 6.
Figure 8:
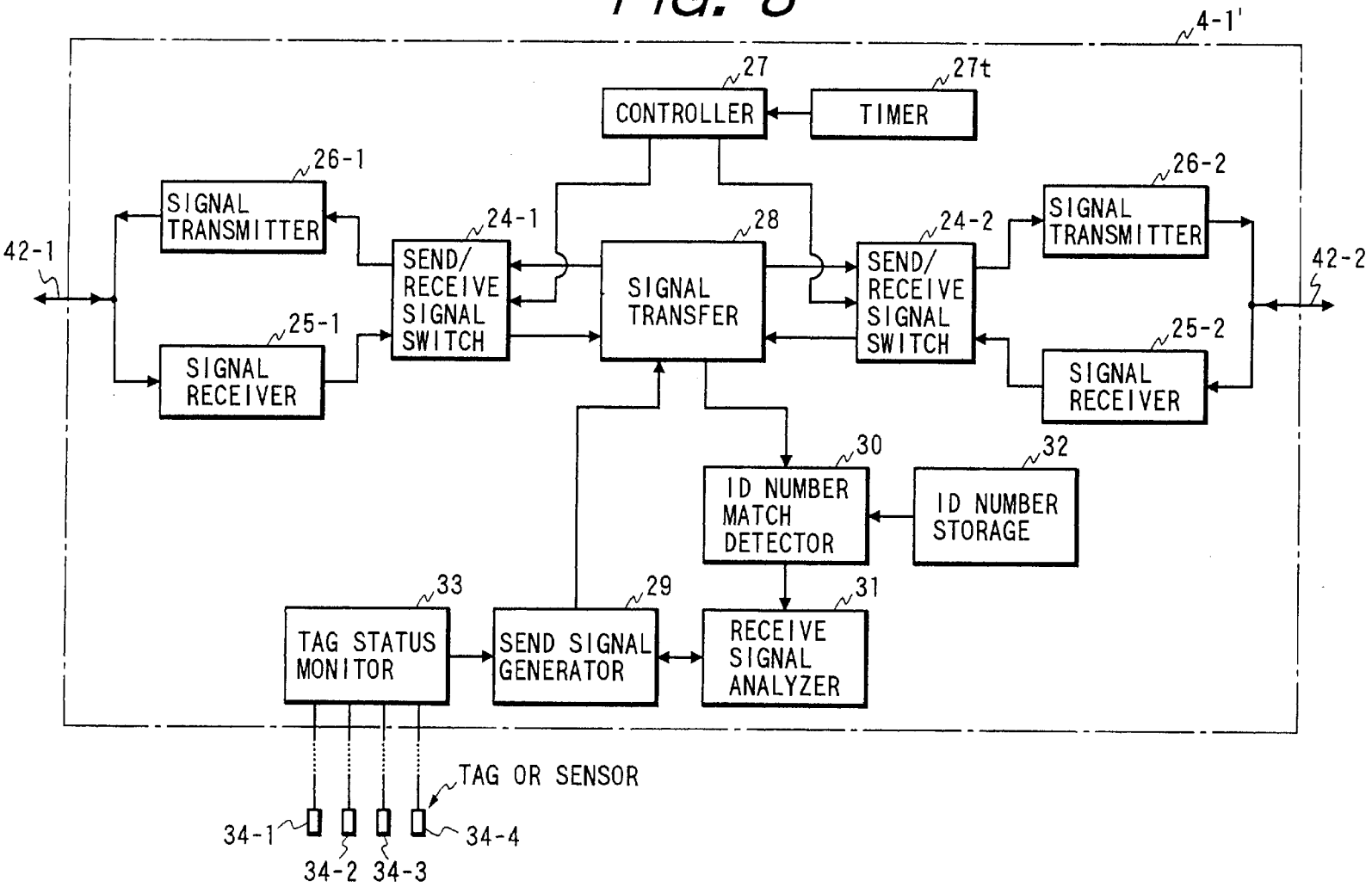
FIG. 8 is a block diagram illustrating the repeater of the signal transmission apparatus of FIG. 1 practiced as a seventh preferred embodiment of the invention.
Figure 9:
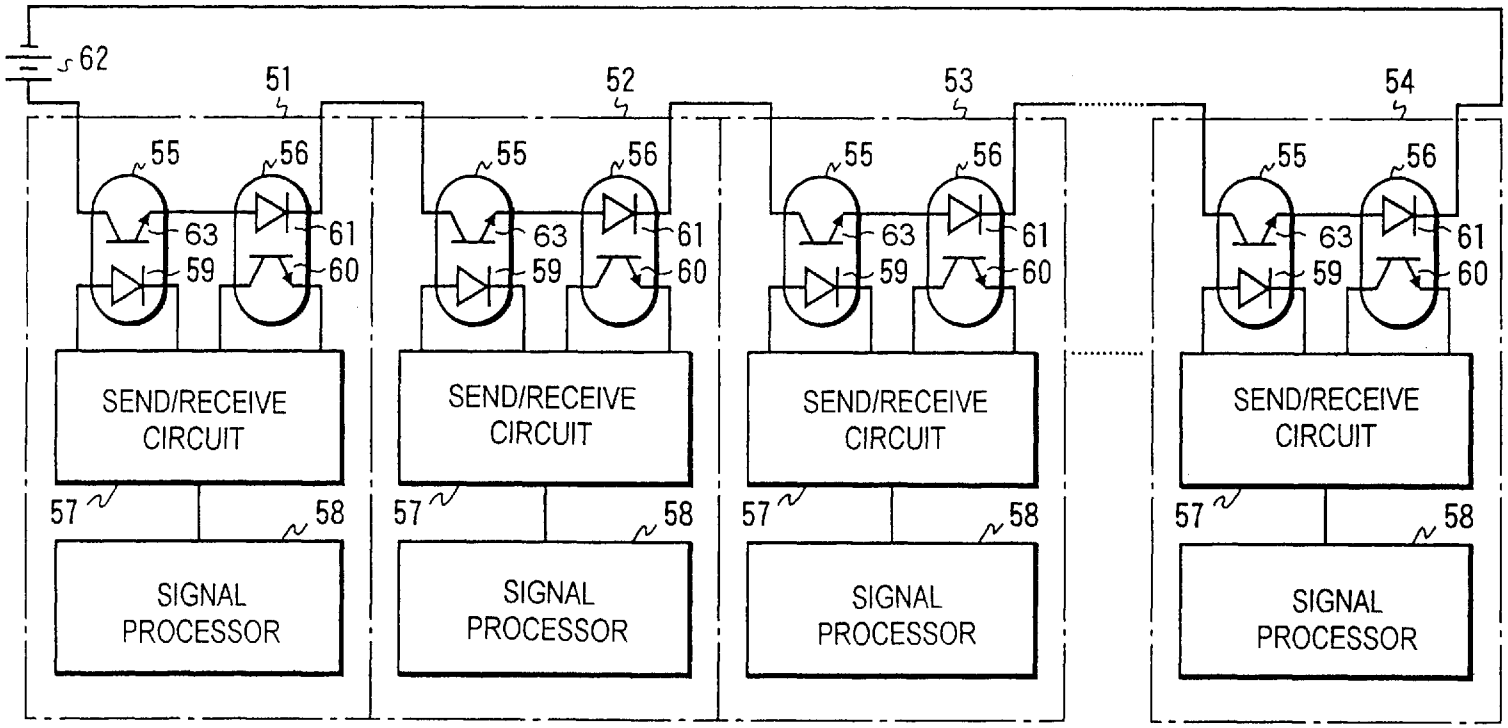
FIG. 9 PRIOR ART
FIG. 9 is a block diagram illustrating an example of a known series-type signal transmission apparatus.
Figure 10:
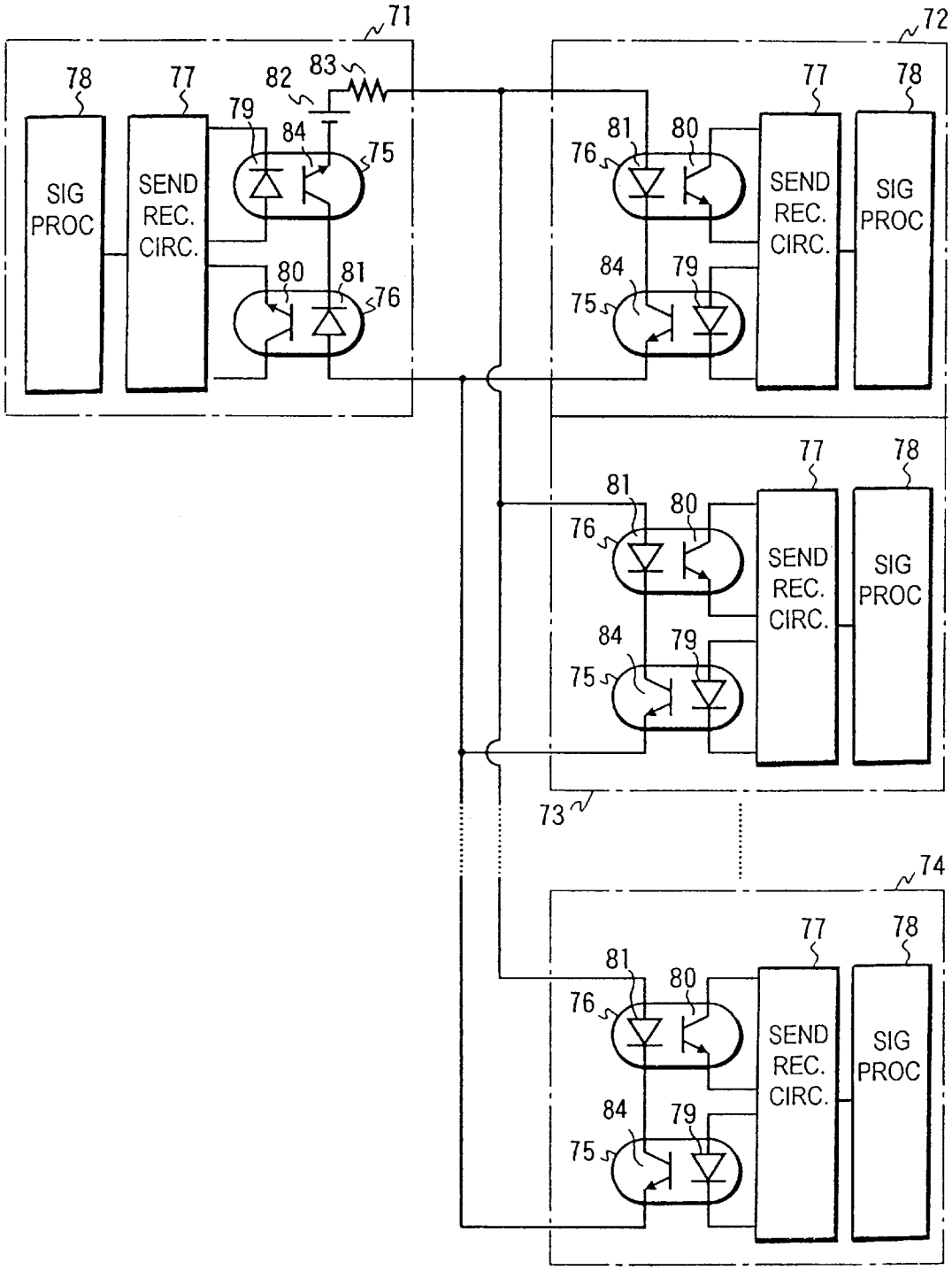
FIG. 10 PRIOR ART
FIG. 10 is a block diagram illustrating an example of a known parallel-type signal transmission apparatus.

FIG. 6 shows a block diagram of the signal processor in the main unit of FIGS. 1(A) and (B), practiced as a sixth preferred embodiment of the present invention. FIG. 7 shows a block diagram of a detailed constitution of a portion of the embodiment of FIG. 6. FIG. 8 shows a block diagram of the signal processor in each repeater of FIGS. 1(A) and (B), practiced as a seventh preferred embodiment of the present invention. In the sixth and seventh embodiments, the signal processor is connected to a repeater connected thereto, which is connected to a next repeater connected thereto and so on by separate connection lines (cables) over which a voltage signal is transmitted.

The differences in constitution between the signal processor 3' of the main unit 1 practiced as the sixth embodiment and the signal processor 3 of the main unit of FIG. 2 practiced as the second embodiment are as follows. In the sixth embodiment, a connection line 42-1 is directly connected to the output terminal of the signal transmitter 16 and the input terminal of the signal receiver 17, and the send/receive signal switch 18 is connected to the input terminal of the signal transmitter 16 and the output terminal of the signal receiver 17. In the second embodiment, the send/receive signal switch 18 is connected to the output terminal of the signal transmitter 16 and the input terminal of the signal receiver 17, and the connection line 8-1 is connected to the send/receive signal switch 18 via the photocouplers 9 and 10. In the sixth embodiment, a voltage signal is transmitted, while a current signal is transmitted in the second embodiment. No further difference exists between the sixth and second embodiments. Therefore, the overall constitution of the signal processor 3' of FIG. 6 will not be described any further.

Now, as shown in FIG. 7, in the sixth embodiment, the signal transmitter 16 has an inverter 38-2 and an emitter-grounded transistor 40 connected to the output terminal of the inverter. The connection line 42-1 is connected to the collector of the transistor 40. The signal receiver 17 has an operational amplifier 39 provided with a negative feedback resistor. The connection line 42-1 is connected to the non-inverted input of the operational amplifier 39. Bias resistors 41-1 and 41-2 are connected to the inverted input. The send/receive signal switch 18 comprises a first controllable inverter 37-1 connected at the input terminal to the send signal generator 23 and at the output terminal to the input terminal of the inverter 38-2, a second controllable inverter 37-2 connected at the input terminal to the output terminal of the operational amplifier 39 and at the output terminal to the ID number match detector 20, and an inverter 38-1 connected at the output terminal to the control terminal of the second controllable inverter 37-2 and at the input terminal to the control terminal of the first controllable inverter 37-1 and to the controller 19.

When the first controllable inverter 37-1 is in the active state under the control of the controller 19 (note that, at this moment, the second controllable inverter 37-2 is in the inactive state), a send signal coming from the send signal generator 23 is transmitted to the transistor 40 via the first controllable inverter 37-1 and the inverter 38-2. The signal is then transmitted from the collector of the transistor 40 to the adjacently connected repeater, not shown in FIG. 7, as a voltage signal via the connection line 42-1. On the other hand, when the second controllable inverter 37-2 is in the active state under the control of the controller 19 (note that, at this moment, the first controllable inverter 37-1 is in the inactive state), the voltage signal coming from the adjacently connected repeater via the connection line 42-1 is supplied as a receive signal to the ID number match detector 20 via the operational amplifier 39 and the second controllable inverter 37-2.

No other operations are different between the signal processor 3' of FIG. 6 and the signal processor 3 of FIG. 2, so that the operations of the sixth embodiment will not be described any further.

The differences in constitution between a signal processor 4-1' in each of the repeaters 2-1 through 2-4 of FIG. 8 practiced as a seventh preferred embodiment of the present invention and the signal processor 4-1 of FIG. 3 practiced as the third preferred embodiment are as follows. In the seventh embodiment, a connection line 42-1 is connected to the output terminal of the signal transmitter 26-1 and the input terminal of the signal receiver 25-1 and the connection line 42-2 is directly connected to the output terminal of the signal transmitter 26-2 and the input terminal of the signal receiver 25-2, the send/receive signal switch 24-1 is connected to the input terminal of the signal transmitter 26-1 and the output terminal of the signal receiver 25-1, and the send-receive signal switch 24-2 is connected to the input terminal of the signal transmitter 26-2 and the output terminal of the signal receiver 25-2. In the third embodiment, the send/receive signal switch 24-1 is connected to the output terminal of the signal transmitter 26-1 and the input terminal of the signal receiver 25-1, the send/receive signal switch 24-2 is connected to the output terminal of signal transmitter 26-2 and the input terminal of the signal receiver, the loop connection line 8-1 is connected to the send/receive signal switch 24-1 via the photocouplers 11 and 12, and the loop connection line 8-2 is connected to the send/receive signal switch 24-2 via the photocouplers 13 and 14. In addition, in the third embodiment a current signal is transmitted, while in the seventh embodiment a voltage signal is transmitted. There is no further difference in constitution between the signal processor 4-1' of the seventh embodiment and the signal processor 4-1 of the third embodiment. Therefore, the constitution of the signal processor 4-1' of FIG. 8 will not be described any further.

The operations of the signal processor 4-1' of the seventh embodiment are generally the same as those of the signal processor 4-1 of the third embodiment. Therefore, the operations of the signal processor 4-1' will not be described any further.

According to the seventh preferred embodiment of the present invention, the connection lines 42-1 and 42-2 that do not require the photocouplers 9 through 14 for signal transmission, resulting in the less costly signal transmission apparatus at the expense of slightly poor noise characteristic as compared with the third embodiment using these photocouplers.

While the preferred embodiments of the present invention have been described using specific terms, such description is for illustrative purposes only, and it is to be understood that changes and variations may be made without departing from the spirit or scope of the appended claims.

For example, in each of the above-mentioned embodiments, the signal transmission apparatus has been described as embodied in a theft monitoring apparatus. It will be apparent to those skilled in the art that the present invention is also applicable to other generally similar apparatuses than the theft monitoring apparatus.

As described and according to the present invention, the main unit 1 and one sub unit (repeater) 2-1 is connected with the loop connection line 8-1 and the sub units 2-1 through 2-4 are interconnected with the loop connection lines 8-2 through 8-4 respectively. A current signal is transmitted between the main unit 1 and the first sub unit 2-1 and between the first through fourth sub units 2-1 through 2-4 individually and sequentially. Each of the loop connection lines 8-1 through 8-5 is only connected with the current source 15 and two pairs of phototransistors and LEDs. For the current source 15 that drives each loop connection line, the voltage drop in the two pairs of phototransistors and LEDs may only be considered. Consequently, the current source 15 may only be one that generates a low voltage of about 10 V and a small current of about 20 mA sufficient for driving the two LEDs at constant current.

Thus, according to the present invention, the novel signal transmission apparatus requires no current source having a large power capacity which generates a high voltage and a large current, thereby significantly reducing power consumption and fabrication cost. In addition, there is substantially no limitation to the number of sub units (repeaters) to be connected to the main unit and the length of the connection lines for interconnecting these units, thereby allowing the user to design a desired signal transmission apparatus without considering its total length.

Further, according to the present invention, when the signal transmission apparatus is activated, a number setting instructing signal or a new number setting instructing signal is transmitted from the main unit to the interconnected sub units (repeaters) sequentially to assign unique ID numbers to the sub units and display the assigned ID numbers on the display device 36 of the sub units, the ID numbers indicating the sequential orders of the connection from the main unit. When the ID numbers have been set to sub units (the first through fourth repeaters 2-1 through 2-4), the ID number of the sub unit connected at the end of the series of the interconnected sub units is sent back to the main unit 1.

Thus, manual assignment of unique ID numbers and manual labeling of ID number seals on the sub units need not be performed, so that all sub units can be manufactured in the same manufacturing process, thereby significantly reducing manufacturing cost. And the novel setup prevents ID number assignment mistakes from happening and allows the user to know the number of sub units connected to the main unit by supplying from the main unit the ID numbers to the sub units.

Still further, according to the present invention, a voltage signal is transmitted between the main unit 1 and the sub unit (the first repeater 2-1) via the connection line 42-1 and between the sub units (the first through fourth repeaters 2-1 through 2-4) via the connection lines 42-2 through 42-4 individually and sequentially, thereby requiring no great drive voltage.

Thus, unlike the conventional signal transmission apparatuses, the signal transmission apparatus according to the present invention need not use a lot of photocouplers and therefore a great drive voltage, thereby making the apparatus less costly than conventional ones.

What is claimed is:

1. A signal transmission apparatus comprising:

a main unit having a first signal transmission terminal including first and second photocouplers;

a sub unit having a second signal transmission terminal and a third signal transmission terminal, each of the second signal transmission terminal and the third signal transmission terminal including first and second photocouplers; and a plurality of loop connection lines including a first loop connection line linking the first signal transmission terminal of said main unit and said second transmission terminal of said sub unit, and a second loop connection line connected to said third signal transmission terminal of said sub unit;

wherein said main unit further includes control means, signal generating means for generating and sending a first current signal to said sub unit in response to control signals from said control means, and signal processing means for processing a second current signal received from said sub unit, and wherein said sub unit further includes control means, in a destination signal determination means for determining a destination of said first current signal supplied to said second signal transmission terminal, and signal transfer means for capturing said first current signal if, based on a result of determination made by said destination signal determination means, said first current signal is addressed to said sub unit, for transferring said first current signal to said third signal transmission terminal if said first current signal is not addressed to said sub unit, and for transferring said second current signal supplied to said third signal transmission terminal from said second loop connection line to said first signal transmission terminal through said second signal transmission terminal and said first loop connection line.

2. A signal transmission apparatus according to claim 1, wherein said main unit is incorporated into a theft monitoring apparatus for performing theft monitoring by a plurality of tags and said sub unit is a repeater connected to said plurality of tags.

3. A signal transmission apparatus comprising:

a main unit having a first signal transmission terminal including first and second photocouplers;

a sub unit having a second signal transmission terminal and a third signal transmission terminal, each of the second signal transmission terminal and the third signal transmission terminal including first and second photocouplers; and a plurality of loop connection lines including a first loop connection line linking the first signal transmission terminal of said main unit and said second transmission terminal of said sub unit, and a second loop connection line connected to said third signal transmission terminal of said sub unit;

wherein said main unit further includes control means, number command means for sending a number setting command signal to said sub unit in response to a command signal from said control means, and response signal receiving means for receiving a response signal coming from said sub unit, and wherein said sub unit further includes control means, number setting means for generating, based on said number setting command signal supplied to said second signal transmission terminal, a sub unit number for said sub unit, said sub unit number indicating a sequential connection position of said sub unit relative to said main unit, and display means for displaying said sub unit number generated by said number setting means.

4. A signal transmission apparatus according to claim 3, wherein said sub unit further comprises completion signal generating means for generating a setting completion signal and for sending the setting completion signal from said second signal transmission terminal after the sub unit number of said sub unit has been set by said number setting means, and new number command means for generating a second number setting command signal and for sending the second number setting command signal from said third signal transmission terminal after the sub unit number of said sub unit has been set by said number setting means.

5. A signal transmission apparatus according to claim 4, wherein said completion signal generating means of said sub unit further comprises means for, if a second setting completion signal is not supplied to said third signal transmission terminal within a certain time after transmission of said second number setting command signal from said new number command means from said third signal transmission terminal, sending said sub unit number from said second signal transmission terminal.

6. A signal transmission apparatus according to claim 3, wherein said main unit is incorporated into a theft monitoring apparatus for performing theft monitoring by a plurality of tags and said sub unit is a repeater connected to said plurality of tags.

7. A signal transmission apparatus comprising:

a main unit having a first signal transmission terminal including signal sending means and signal receiving means;

a sub unit having a second signal transmission terminal and a third signal transmission terminal, each of the second signal transmission terminal and the third signal transmission terminal including a signal sending means and signal receiving means; and a plurality of loop connection lines including a first loop connection line linking the first signal transmission terminal of said main unit and said second transmission terminal of said sub unit, and a second loop connection line connected to said third signal transmission terminal of said sub unit;

wherein said main unit further includes control means, signal generating means for generating and sending a first voltage signal to said sub unit in response to control signals from said control means, and signal processing means for processing a second voltage signal received from said sub unit, and wherein said sub unit further includes control means, a destination signal determination means for determining a destination of said first voltage signal supplied to said second signal transmission terminal, and signal transfer means for, based on a result of determination made by said destination signal determination means, capturing said first voltage signal supplied to said second signal transmission terminal if said first voltage signal is addressed to said sub unit and, if said first voltage signal is not addressed to said sub unit, transferring said first voltage signal to said third signal transmission terminal and transferring said first voltage signal on said second loop connection line.

8. A signal transmission apparatus according to claim 7, wherein said main unit is incorporated into a theft monitoring apparatus for performing theft monitoring by a plurality of tags and said sub unit is a repeater connected to said plurality of tags.

* * * * *

UNITED STATES PATENT AND TRADEMARK OFFICE

CERTIFICATE OF CORRECTION

PATENT NO. : 5,815,074

DATED : September 29, 1998

INVENTOR(S) : Shinichi Sasagawa et al.

It is certified that error appears in the above-indentified patent and that said Letters Patent is hereby corrected as shown below:

In the Claims

Column 18:

In Claim 1, line 21, delete "in".

Signed and Sealed this

Thirtieth Day of March, 1999

*Attest:*

*Attesting Officer*

Q. TODD DICKINSON

*Acting Commissioner of Patents and Trademarks*